US008678161B2

(12) United States Patent
Masuda et al.

(10) Patent No.: US 8,678,161 B2
(45) Date of Patent: Mar. 25, 2014

(54) COIN DEPOSITING AND DISPENSING MACHINE

(75) Inventors: Yoshifumi Masuda, Hyogo (JP); Youhei Kamada, Hyogo (JP)

(73) Assignee: Glory Ltd., Himeji-Shi, Hyogo-Ken (JP)

( * ) Notice: Subject to any disclaimer, the term of this patent is extended or adjusted under 35 U.S.C. 154(b) by 0 days.

(21) Appl. No.: 13/147,723

(22) PCT Filed: Feb. 2, 2010

(86) PCT No.: PCT/JP2010/051379

§ 371 (c)(1),
(2), (4) Date: Oct. 10, 2011

(87) PCT Pub. No.: WO2010/090163

PCT Pub. Date: Aug. 12, 2010

(65) Prior Publication Data

US 2012/0018277 A1 Jan. 26, 2012

(30) Foreign Application Priority Data

Feb. 3, 2009 (JP) ..... 2009-022212

(51) Int. Cl.
*G07F 9/02* (2006.01)

(52) U.S. Cl.
USPC ..... 194/200

(58) Field of Classification Search
USPC ..... 194/200, 215, 344, 350; 221/1, 17, 21
See application file for complete search history.

(56) References Cited

U.S. PATENT DOCUMENTS

| | | | | |
|---|---|---|---|---|
| 5,813,510 | A | 9/1998 | Rademacher | |
| 6,155,398 | A | 12/2000 | Sagady | |
| 6,685,551 | B2 * | 2/2004 | Adams et al. | 453/24 |
| 7,497,314 | B2 * | 3/2009 | Umeda | 194/302 |
| 8,210,336 | B2 | 7/2012 | Nishida | |
| 2002/0077056 | A1 | 6/2002 | Abe et al. | |
| 2003/0116401 | A1 * | 6/2003 | Ishida et al. | 194/302 |
| 2007/0212997 | A1 * | 9/2007 | Kurosawa | 453/49 |

FOREIGN PATENT DOCUMENTS

| | | |
|---|---|---|
| JP | 6-38280 | 2/1994 |
| JP | 10-240996 | 9/1998 |
| JP | 11-134535 | 5/1999 |

(Continued)

OTHER PUBLICATIONS

European Search Report (Application No. 10738495.0—PCT/JP2010051379) (dated May 22, 2012—6 pages).

(Continued)

*Primary Examiner* — Mark Beauchaine

(74) *Attorney, Agent, or Firm* — Renner, Kenner, Grieve, Bobak, Taylor & Weber

(57) ABSTRACT

The present invention provides a coin depositing and dispensing machine 11 that can be continuously used without going out-of-service even if a failure occurs in a certain storing and dispensing portion. Among a plurality of storing and dispensing portions 22 to 27, denominations of coins to be stored are assigned to the storing and dispensing portions 22 to 25, respectively, and no denomination is assigned to the storing and dispensing portions 26 and 27. When a failure occurs in one of the storing and dispensing portions 22 to 25, the assignment of a denomination related to the failure is changed from the storing and dispensing portion in which the failure occurred to either one of the storing and dispensing portion 26 and 27 to which no denomination is assigned.

6 Claims, 2 Drawing Sheets

(56) References Cited

FOREIGN PATENT DOCUMENTS

| | | | | |
|---|---|---|---|---|
| JP | 2001-266208 | | 9/2001 | |
| JP | 2001-283276 | * | 10/2001 | ..... G07D 1/00 |
| JP | 2006-146367 | | 6/2006 | |
| JP | 2007-279910 | | 10/2007 | |
| WO | WO 99/21141 A1 | | 4/1999 | |
| WO | WO 02/067206 A2 | | 8/2002 | |

OTHER PUBLICATIONS

European Patent Office Communication (Application No. 10 738 495.0) (dated Jan. 24, 2013—5 pages).
Japanese Office Action (for corresponding Japanese Patent Application No. 2009-022212) (3 pages—dated Jun. 25, 2005).
Japanese Office Action (for corresponding Japanese Patent Application No. 2009-022212) (3 pages—dated 26.1.24).

* cited by examiner

COIN DEPOSITING AND DISPENSING MACHINE

CROSS-REFERENCE TO RELATED APPLICATION

This application claims priority from International Application No. PCT/JP2010/051379 filed Feb. 2, 2010 which is based on Japanese Application No. JP2009-022212 filed Feb. 3, 2009, which are incorporated herein by reference in its entirety.

TECHNICAL FIELD

The present invention relates to a coin depositing and dispensing machine that deposits and dispenses coins.

BACKGROUND ART

As a coin depositing and dispensing machine, there is conventionally one that is installed in a financial institution such as a bank and cyclically uses deposited coins as coins to be dispensed.

The coin depositing and dispensing machine includes denomination-specific storing and dispensing portions that store coins in advance, and a bulk storing unit that collectively stores coins of various denominations when the coins are deposited or stores in advance coins of various denominations in a mixed manner as coins to be replenished.

In a depositing process, coins are respectively dispensed from storing and dispensing portions for denominations to be dispensed, and when a shortage of coins to be dispensed occurs in a storing and dispensing portion or when a failure occurs in coin dispensing from the storing and dispensing portion for the denomination to be dispensed; coins are fed from the bulk storing unit; the denominations of the coins fed from the bulk storing unit are recognized by a recognition unit, and only coins of denominations that can be dispensed as an alternative are dispensed, thereby completing the dispensing process (for example, refer to Patent Document 1).

CITATION LIST

Patent Literature

PTL 1: Japanese Patent Publication No. 6-38280 (page 7, FIG. 1)

SUMMARY OF INVENTION

Technical Problem

As described above, in the conventional coin depositing and dispensing machine, when a failure occurs in a storing and dispensing portion during a dispensing process, the dispensing process can be completed by alternative dispensing; however, after the dispensing process, the machine immediately goes out-of-service. Therefore, until the machine is restored from the failure by a failure restoration operation, the coin depositing and dispensing machine remains out-of-service.

If the failure requires component replacement, immediate restoration is impossible, resulting in the coin depositing and dispensing machine going out-of-service for a long period of time until the component replacement is arranged.

The present invention has been made taking into consideration these circumstances, and an object thereof is to provide a coin depositing and dispensing machine that can be continuously used without going out-of-service even if a failure occurs in a certain storing and dispensing portion.

Solution to Problem

A coin depositing and dispensing machine according to a first aspect of the invention includes a transport unit that transports coins to be deposited or dispensed, a recognition unit that recognizes coins being transported by the transport unit, a plurality of storing and dispensing portions to which denominations of coins to be stored are assigned and which receive and store coins of corresponding denominations from the transport unit and are capable of dispensing stored coins to the transport unit, a failure detection unit that detects occurrence of a failure in the storing and dispensing portion, and a control unit that, when occurrence of a failure in the storing and dispensing portion for a certain denomination is detected by the failure detection unit, changes the assignment of the denomination related to the failure from the storing and dispensing portion in which the failure occurred to another storing and dispensing portion.

A coin depositing and dispensing machine according to a second aspect of the invention is configured so that, in the coin depositing and dispensing machine according to the first aspect of the invention, the number of the plurality of storing and dispensing portions is larger than the number of denominations to be assigned thereto, with no denomination being assigned to at least one of the storing and dispensing portions, and when a failure occurs in the storing and dispensing portion for a certain denomination, the control unit changes the assignment of the denomination related to the failure from the storing and dispensing portion in which the failure occurred to the storing and dispensing portion to which no denomination is assigned.

A coin depositing and dispensing machine according to a third aspect of the invention includes, in the coin depositing and dispensing machine according to the first aspect of the invention, a bulk storing unit that collectively stores coins of a plurality of denominations, wherein, when a failure occurs in the storing and dispensing portion for a certain denomination, the control unit makes the bulk storing unit store coins for a denomination that is less frequently used, thereby emptying the storing and dispending portion storing the coins for the less frequently used denomination, and changes the assignment of the denomination related to the failure from the storing and dispensing portion in which the failure occurred to the emptied storing and dispensing portion.

A coin depositing and dispensing machine according to a fourth aspect of the invention is configured so that, in the coin depositing and dispensing machine according to the first aspect of the invention, when a failure occurs in the storing and dispensing portion for a certain denomination, the control unit changes the assignment of the denomination related to the failure from the storing and dispensing portion in which the failure occurred to a storing and dispensing portion to which another denomination has already been assigned so that the later-assigned storing and dispensing portion stores coins of a plurality of denominations in a mixed manner.

A coin depositing and dispensing machine according to a fifth aspect of the invention includes, in the coin depositing and dispensing machine according to the first aspect of the invention, an informing unit that that provides notification to the outside, wherein, when a failure occurs in the storing and dispensing portion for a certain denomination, the control unit makes the informing unit provide notification that replenishment of coins of the denomination related to the failure is necessary.

A coin depositing and dispensing machine according to a sixth aspect of the invention includes, in the coin depositing and dispensing machine according to the first aspect of the invention, a bulk storing unit capable of collectively storing coins of a plurality of denominations and capable of feeding the stored coins into the transport unit, wherein, when a failure occurs in the storing and dispensing portion for a certain denomination, the control unit feeds coins from the bulk storing unit into the transport unit and selects from among the coins being transported in the transport unit coins of the denomination related to the failure and replenishes coins into the storing and dispensing portion to which the denomination related to the failure is assigned.

A coin depositing and dispensing machine according to a seventh aspect of the invention is configured so that, in the coin depositing and dispensing machine according to the first aspect of the invention, when a failure occurs in the storing and dispensing portion storing coins of a denomination to be dispensed, and it is possible for an equivalent amount of coins to be dispensed in other denominations, the control unit makes the storing and dispensing portions for other denominations dispense coins of the other denominations.

A coin depositing and dispensing machine according to an eighth aspect of the invention includes a feeding unit that receives and feeds coins to be deposited, a transport unit that transports coins fed from the feeding unit, a recognition unit that recognizes coins being transported by the transport unit, an escrow unit that receives and escrows coins recognized by the recognition unit from the transport unit and escrows the coins and is capable of feeding the escrowed coins to the transport unit, a plurality of storing and dispensing portions to which denominations of coins to be stored are assigned and which receive and store coins of corresponding denominations of coins fed from the escrow unit to the transport unit and are capable of dispensing stored coins to the transport unit, a failure detection unit that detects occurrence of a failure in the storing and dispensing portion, and a control unit that, in a case where occurrence of a failure in the storing and dispensing portion for a certain denomination is detected by the failure detection unit when the control unit makes the storing and dispensing portion store the coins escrowed in the escrow unit, changes the assignment of the denomination related to the failure to the feeding unit.

A coin depositing and dispensing machine according to a ninth aspect of the invention includes a transport unit that transports coins to be deposited or dispensed, a recognition unit that recognizes coins being transported in the transport unit, a plurality of storing and dispensing portions to which denominations of coins to be stored are assigned and which receive and store coins of corresponding denominations from the transport unit and are capable of dispensing stored coins to the transport unit, a bulk storing unit capable of collectively storing coins of a plurality of denominations and capable of feeding the coins into the transport unit, a failure detection unit that detects occurrence of a failure in the storing and dispensing portion, and a control unit that, when occurrence of a failure in the storing and dispensing portion for a certain denomination is detected by the failure detection unit, changes the assignment of the denomination related to the failure from the storing and dispensing portion in which the failure occurred to the bulk storing unit.

Advantageous Effects of Invention

With the coin depositing and dispensing machine according to the first aspect of the invention, when a failure occurs in the storing and dispensing portion for a certain denomination, the assignment of the denomination related to the failure is changed from the storing and dispensing portion in which the failure occurred to another storing and dispensing portion, so that the machine can be continuously used without going out-of-service.

With the coin depositing and dispensing machine according to the second aspect of the invention, in addition to the effect of the coin depositing and dispensing machine according to the first aspect of the invention, when a failure occurs in the storing and dispensing portion for a certain denomination, the assignment of the denomination related to the failure is changed from the storing and dispensing portion in which the failure occurred to the storing and dispensing portion to which no denomination is assigned, so that the machine can be continuously used without going out-of-service.

With the coin depositing and dispensing machine according to the third aspect of the invention, in addition to the effect of the coin depositing and dispensing machine according to the first aspect of the invention, when a failure occurs in the storing and dispensing portion for a certain denomination, the bulk storing unit is made to store coins for a denomination that is less frequently used, thereby emptying the storing and dispensing portion storing the coins for the less frequently used denomination, and the assignment of the denomination related to the failure is changed from the storing and dispensing portion in which the failure occurred to the emptied storing and dispensing portion, so that the machine can be continuously used without going out-of-service.

With the coin depositing and dispensing machine according to the fourth aspect of the invention, in addition to the effect of the coin depositing and dispensing machine according to the first aspect of the invention, when a failure occurs in the storing and dispensing portion for a certain denomination, the assignment of the denomination related to the failure is changed from the storing and dispensing portion in which the failure occurred to a storing and dispensing portion to which another denomination has already been assigned so that the later-assigned storing and dispensing portion stores coins of a plurality of denominations in a mixed manner. As a result, the machine can be continuously used without going out-of-service.

With the coin depositing and dispensing machine according to the fifth aspect of the invention, in addition to the effect of the coin depositing and dispensing machine according to the first aspect of the invention, when a failure occurs in the storing and dispensing portion for a certain denomination, the informing unit is made to provide notification that replenishment of coins of the denomination related to the failure is necessary, thereby prompting replenishment of coins of the denomination related to the failure.

With the coin depositing and dispensing machine according to the sixth aspect of the invention, in addition to the effect of the coin depositing and dispensing machine according to the first aspect of the invention, when a failure occurs in the storing and dispensing portion for a certain denomination, coins are fed from the bulk storing unit into the transport unit, and coins of the denomination related to the failure of the coins are selected from among the coins being transported in the transport unit and are replenished into the storing and dispensing portion to which the denomination related to the failure is assigned, so that coins of the denomination related to the failure can be automatically replenished.

With the coin depositing and dispensing machine according to the seventh aspect of the invention, in addition to the effect of the coin depositing and dispensing machine according to the first aspect of the invention, when a failure occurs in the storing and dispensing portion storing coins of a denomination to be dispensed, and it is possible for an equivalent amount of coins to be dispensed in other denominations, coins of the other denominations are dispensed from the storing and dispensing portions for the other denominations, so that the machine can be continuously used without going out-of-service.

With the coin depositing and dispensing machine according to the eighth aspect of the invention, coins to be deposited are fed from the feeding unit, and after the fed coins are recognized by the recognition unit and then escrowed in the escrow unit, in a case where a failure occurs in the storing and dispensing portion for a certain denomination when the coins escrowed in the escrow unit are stored in the storing and dispensing portions, the assignment of the denomination related to the failure is changed to the feeding unit, so that the machine can be continuously used without going out-of-service.

With the coin depositing and dispensing machine according to the ninth aspect of the invention, when occurrence of a failure in the storing and dispensing portion for a certain denomination is detected, the assignment of the denomination related to the failure is changed from the storing and dispensing portion in which the failure occurred to the bulk storing unit, so that the machine can be continuously used without going out-of-service.

DESCRIPTION OF EMBODIMENTS

Hereinafter, an embodiment of the present invention will be described with reference to the drawings.

Figure 1:
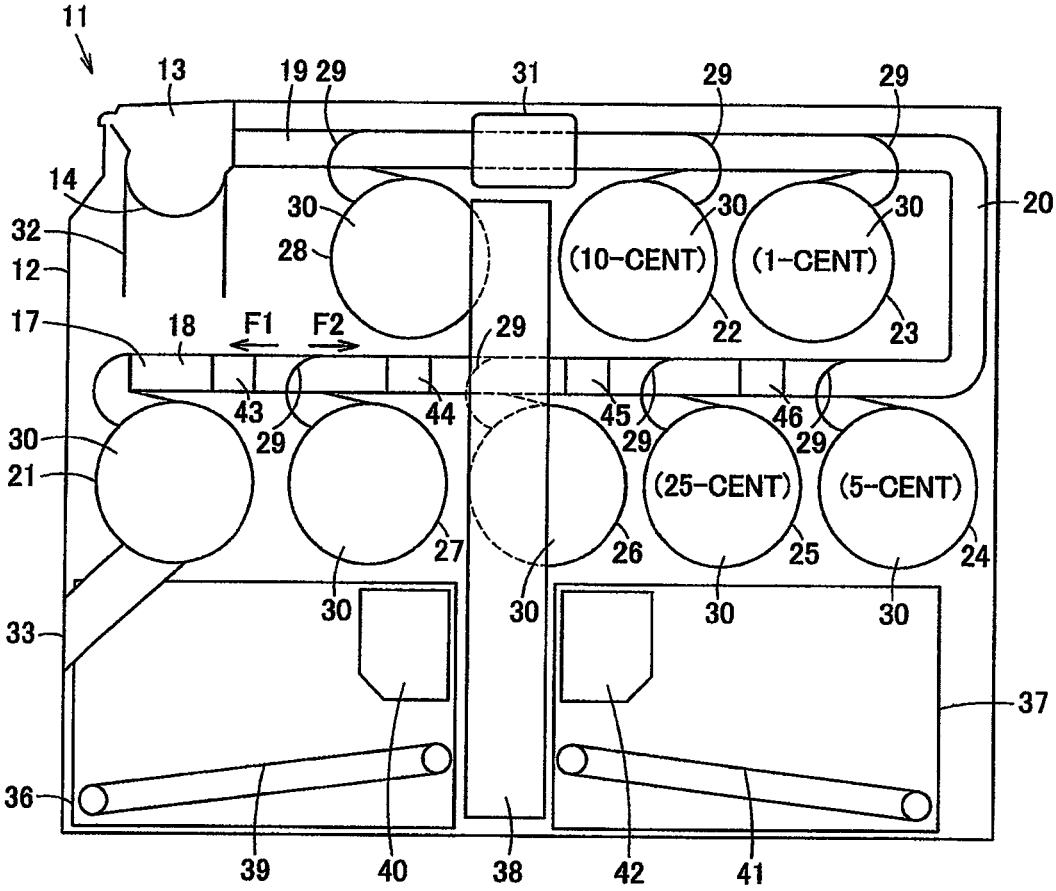
FIG. 1 is a side view showing an internal structure of a coin depositing and dispensing machine showing an embodiment of the present invention.

As shown in FIG. 1, a coin depositing and dispensing machine 11 includes a machine body 12, and on an upper portion front side (left side in FIG. 1) of the machine body 12, a transaction port 13 serving as an input port for depositing coins and an output port for dispensing coins is formed. At the transaction port 13, a shutter not shown is disposed so as to open and close.

On the lower side of the transaction port 13, a tray 14 that receives and pools coins is formed. In the tray 14, coins such as deposited coins input into the transaction port 13 from the outside of the machine body 12 are received and coins such as dispensed coins and returned coins to be dispensed to the transaction port 13 from the inside of the machine body 12 are received. A part of the bottom surface of the tray 14 is openable and closable, and by opening this part, coins can be ejected downward.

On the upper portion side of the machine body 12, a transport unit 17 that transports coins one by one separately is disposed. The transport unit 17 includes a passage member that guides coins and a transporting belt that transports coins along the passage member, etc. The transport unit 17 includes a first transport path 18 provided in the front-rear direction of the machine body 12, a second transport path 19 provided in the front-rear direction at a position above the first transport path 18, and a third transport path 20 connecting the rear ends of these first transport path 18 and second transport path 19. The front end of the second transport path 19 is connected to the transaction port 13 so that coins transported to the front end of the second transport path 19 can be ejected into the tray 14. The direction of transportation of coins from the second transport path 19 to the third transport path 20 and the first transport path 18 is referred to as a deposit transporting direction F1, and on the other hand, the direction of transportation of coins from the first transport path 18 to the third transport path 20 and the second transport path 19 is referred to as a dispensing transporting direction F2.

A feeding unit 21 is connected to the front end of the first transport path 18, a plurality of storing and dispensing portions 22 to 27 are connected to a rear part of the first transport path 18 relative to the feeding unit 21 of the first transport path 18 and the second transport path 19, and an escrow unit 28 is connected to the side forward relative to the storing and dispensing portions 22 and 23 of the second transport path 19. Among the plurality of storing and dispensing portions 22 to 27, for example, 10-cent coins are assigned to the storing and dispensing portion 22, 1-cent coins are assigned to the storing and dispensing portion 23, 5-cent coins are assigned to the storing and dispensing portion 24, and 25-cent coins are assigned to the storing and dispensing portion 25, and no denomination are assigned to the storing and dispensing portions 26 and 27.

The feeding unit 21, each of the storing and dispensing portions 22 to 27, and the escrow unit 28 each includes, for example, a rotary disk disposed in an inclined manner, and a hopper that stores coins therein, with the surface of the rotary disk facing the hopper. The feeding unit 21, the storing and dispensing portions 22 to 27, and the escrow unit 28 each includes a sorting mechanism 29 that sorts corresponding coins of coins being transported in the transport unit 17 from the feeding unit 17 to the feeding unit 21, the storing and dispensing portions 22 to 27, and the escrow unit 28, respectively, and stores the sorted coins therein, and a feeding mechanism 30 that feeds coins stored in the feeding unit 21, the storing and dispensing portions 22 to 27, and the escrow unit 28 one by one to the transport unit 17. The sorting mechanism 29 sorts coins being transported in the transport unit 17 to the feeding unit 21, the storing and dispensing portions 22 to 27, and the escrow unit 28, respectively, and allows the coins to pass through to the downstream side in the transporting direction of the transport unit 17 by advancing or retracting a sorting member with respect to the transport unit 17 by driving of a solenoid. The feeding mechanism 30 rotates the rotary disk by a motor, picks coins up one by one by a protrusions provided on the surface of the rotary disk, and feeds by a feeding disk the coins picked up by the rotary disk to the transport unit 17 by a feeding disk. The configurations of the sorting mechanism 29 and the feeding mechanism 30 are not limited to the above-described configurations, and other configurations may also be adopted.

Between the storing and dispensing portion 22 and the escrow unit 28 in the second transport path 19, a recognition unit 31 that recognizes at least denominations, authenticity, and soundness of coins being transported is disposed.

The feeding unit 21 is positioned below the tray 14, and between the tray 14 and the feeding unit 21, a chute 32 that guides coins ejected from the tray 14 to the feeding unit 21 is provided. In the feeding unit 21, foreign material input together with deposited coins can be discharged and returned to a return port 33 provided on the front face of the machine body 12.

At a lower portion inside the machine body 12, an overflow stacker 36 that serves as a bulk storing unit for storing overflow coins that are in excess of the storage capacity of the storing and dispensing portions 22 to 27 is disposed, and a coin cassette 37 that serves as a bulk storing unit for storing replenishment coins and collected coins is disposed. Between the overflow stacker 36 and the coin cassette 37, a transport mechanism 38 that transports coins fed from the overflow stacker 36 and the coin cassette 37 to the escrow unit 28 on the upper side is disposed.

In the overflow stacker 36, a belt 39 that feeds coins to the transport mechanism 38 and a collection cassette 40 that collects unremoved coins, which are coins left behind inside the tray 14 are disposed. In the coin cassette 37, a belt 41 that feeds coins to the transport mechanism 38 and a reject box 42 that collects rejected coins are disposed.

The first transport path 18 is provided with a diverting unit 43 that diverts overflow coins to the overflow stacker 36, a diverting unit 44 that diverts unremoved coins to the collection cassette 40, a diverting unit 45 that diverts rejected coins to the reject box 42, and a diverting unit 46 that diverts collected coins to the coin cassette 37.

Each of the overflow stacker 36 and the coin cassette 37 functions as a bulk storing unit that collectively stores coins of a plurality of denominations and is capable of feeding the collectively stored coins into the transport unit 17.

Figure 2:
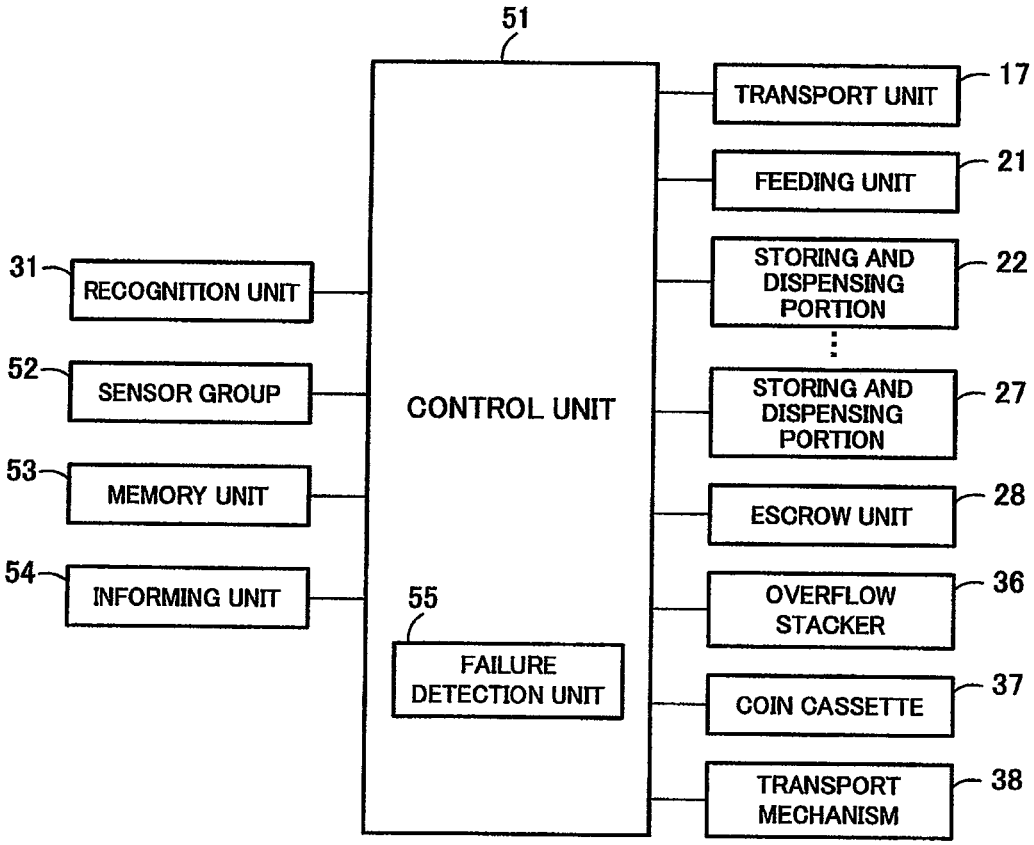
FIG. 2 is a block diagram of the same coin depositing and dispensing machine.

As shown in FIG. 2, the coin depositing and dispensing machine 11 includes a control unit 51 that controls the coin depositing and dispensing machine 11. To the control unit 51, the recognition unit 31, a sensor group 52 including a plurality of sensors disposed at various points for detecting coins inside the coin depositing and dispensing machine 11, and a memory unit 53 that stores in memory various data including assignments of denominations are connected. The control unit 51 controls motors and solenoids for driving the transport unit 17, the feeding unit 21, the storing and dispensing portions 22 to 27, the escrow unit 28, the overflow stacker 36, the coin cassette 37, and the transport mechanism 38. The control unit 51 also controls an informing unit 54 that provides notification of relevant information to a display unit of the apparatus in which the coin depositing and dispensing machine 11 is installed or a master terminal connected to the aforementioned apparatus.

The control unit 51 has a function of a failure detection unit 55 that detects occurrence of a failure in the storing and dispensing portions 22 to 25 to which denominations are assigned. The control unit 51 also has a function of, when occurrence of a failure in the storing and dispensing portion for a certain denomination among the storing and dispensing portions 22 to 25 to which denominations are assigned is detected by the failure detection unit 55, changing the assignment of the denomination related to the failure from the storing and dispensing portion in which the failure occurred to another storing and dispensing portion.

When a coin is caught in the sorting mechanism 29 or the feeding mechanism 30 of any one of the storing and dispensing portions 22 to 25 and the coin cannot be stored therein or dispensed therefrom, the failure detection unit 55 detects occurrence of the failure by detecting, by means of a sensor or the like, that a failure has occurred in switchover of the sorting member of the sorting mechanism 29 or a failure of rotation of the rotary disk of the feeding mechanism 30, or by detecting the caught coin itself.

When a failure occurs in a storing and dispensing portion for a certain denomination, the function to change the assignment of the denomination related to the failure from the storing and dispensing portion in which the failure occurred to another storing and dispensing portion includes, for example, a first to third changing functions described below.

By the first changing function, when a failure occurs in a storing and dispensing portion for a certain denomination, the assignment of the denomination related to the failure is changed from the storing and dispensing portion in which the failure occurred to a storing and dispensing portion 26 or 27 to which no denomination is assigned.

By the second changing function, when a failure occurs in a storing and dispensing portion for a certain denomination, a storing and dispensing portion for a denomination that is less frequently used is emptied by collecting coins therefrom into, for example, the coin cassette 37, and the assignment of the denomination related to the failure is changed from the storing and dispensing portion in which the failure occurred to the emptied storing and dispensing portion.

By the third changing function, when a failure occurs in a storing and dispensing portion for a certain denomination, the assignment of the denomination related to the failure is changed from the storing and dispensing portion in which the failure occurred to a storing and dispensing portion to which another denomination has already been assigned.

The control unit 51 has such a function that, when a failure occurs in a storing and dispensing portion for a certain denomination, the control unit 51 makes the informing unit provide notification that replenishing of coins of the denomination related to the failure is necessary, or make coins be fed from the overflow stacker 36 or the coin cassette 37 into the transport unit 17 and enables replenishing of coins of the denomination related to the failure of the coins being transported in the transport unit 17 into the storing and dispensing portion to which the denomination related to the failure is assigned.

Furthermore, when a failure occurs in a storing and dispensing portion storing coins of a denomination to be dispensed and it is possible for an equivalent amount of coins to be dispensed in other denominations, the control unit 51 has a function of making the storing and dispensing portions for other denominations dispense coins of the other denominations.

Next, operations of the coin depositing and dispensing machine 11 will be described.

First, processing operations under normal conditions of the coin depositing and dispensing machine 11 will be described.

In a depositing process, the shutter of the transaction port 13 is opened, coins input from the transaction port 13 are received in the tray 14, and after the shutter of the transaction port 13 is closed, coins in the tray 14 are ejected to the feeding unit 21 on the lower side.

The coins in the feeding unit 21 are fed into the transport unit 17, transported in the dispensing transporting direction F2 by the transport unit 17, and recognized by the recognition unit 31. Coins recognized as normal are sorted to and escrowed in the escrow unit 28 from the transport unit 17. Coins recognized as not normal are sent into the tray 14 from the transport unit 17, and are allowed to be taken out from the tray 14 by opening the shutter of the transaction port 13.

After the process up to the escrow or return of all coins input into the transaction port 13 is completed, when the deposit is approved, the coins in the escrow unit 28 are stored in the storing and dispensing portions 22 to 25, and on the other hand, if the deposit is canceled, the coins in the escrow unit 28 are returned.

Specifically, when the deposit is approved, coins in the escrow unit 28 are fed into the transport unit 17 and transported in the deposit transporting direction F1 by the transport unit 17, recognized by the recognition unit 31, and sorted to and stored in the storing and dispensing portions 22 to 25 for corresponding denominations based on the results of the recognition. Coins of a denomination to be stored in the storing and dispensing portion 22, 23, 24, or 25 that has become full are not stored in the storing and dispensing portion 22, 23, 24, or 25 but are diverted from the transport unit 17 by the diverting unit 43 and stored in the overflow stacker 36.

When the deposit is canceled, coins in the escrow unit 28 are fed into the transport unit 17, transported in the deposit transporting direction F1 by the transport unit 17, and stored in the feeding unit 21. After all coins in the escrow unit 28 are moved into the feeding unit 21, coins in the feeding unit 21 are fed into the transport unit 17, transported in the dispensing transporting direction F2 by the transport unit 17, and sent from the transport unit 17 into the tray 14. By opening the shutter of the transaction port 13, coins are enabled to be taken out from the inside of the tray 14. After the coins are taken out from the tray 14, the shutter of the transaction port 13 is closed, and it is checked by a sensor whether coins remain in the tray 14. When remaining coins are detected, the shutter of the transaction port 13 is opened to enable the coins to be taken out from the tray 14.

In a dispensing process, coins in the storing and dispensing portions 22 to 25 for denominations to be dispensed are dispensed into the transport unit 17, transported in the dispensing transporting direction F2 by the transport unit 17, and recognized by the recognition unit 31. Coins recognized as normal are sent into the tray 14 from the transport unit 17, and coins not recognized as not normal are sorted to and escrowed in the escrow unit 28 from the transport unit 17.

When coins recognized as not normal are sent into the escrow unit 28, feeding of coins from the storing and dispensing portions 22 to 25 is completed, and after coins of an equivalent amount to be dispensed are sent into the tray 14, coins in the escrow unit 28 are fed into the transport unit 17, transported in the deposit transporting direction F1 by the transport unit 17, and recognized by the recognition unit 31; and coins recognized as normal by re-recognition are stored in the corresponding storing and dispensing portions 22 to 25, and coins recognized as not normal even by re-recognition are diverted by the diverting unit 45 of the transport unit 17 and stored in the reject box 42.

After coins of the equivalent amount to be dispensed are sent into the tray 14, by opening the shutter of the transaction port 13, the coins are allowed to be taken out from the tray 14.

Even after a predetermined time elapses from opening of the shutter of the transaction port 13, if remaining coins in the tray 14 are detected by a sensor, the coins are judged as unremoved coins and collected. Specifically, after the shutter of the transaction port 13 is closed, the unremoved coins in the tray 14 are ejected into the feeding unit 21 on the lower side. The unremoved coins in the feeding unit 21 are fed into the transport unit 17, transported in the dispensing transporting direction F2 by the transport unit 17, recognized by the recognition unit 31, and then escrowed in the escrow unit 28, and after the denominations and the number of unremoved coins are checked, the coins are fed from the escrow unit 28 into the transport unit 17, diverted by the diverting unit 44 of the transport unit 17, and stored in the collection cassette 40.

In a replenishing process, coins stored in the overflow stacker 36 or the coin cassette 37 are fed into the transport mechanism 38 and transported to the escrow unit 28 by the transport mechanism 38. The coins in the escrow unit 28 are dispensed into the transport unit 17, transported in the deposit transporting direction F1 by the transport unit 17, recognized by the recognition unit 31, and sorted to and stored in the storing and dispensing portions 22 to 25 for corresponding denominations based on the results of the recognition. Coins of a denomination to be stored in the storing and dispensing portion 22, 23, 24, or 25 that has become full are not stored in the storing and dispensing portion 22, 23, 24, or 25 but are diverted from the transport unit 17 by the diverting unit 43 and stored in the overflow stacker 36.

For example, in a case where coins of a specific denomination such as a denomination related to a failure are replenished, coins to be replenished are input from the transaction port 13, and accordingly, the coins can be replenished into the storing and dispensing portions 22 to 25 by the same coin process flow as in the depositing process.

Next, in each process of the coin depositing and dispensing machine 11, a case where a failure occurs in a storing and dispensing portion for a certain denomination among the storing and dispensing portions 22 to 25 to which denominations are assigned will be described.

It is assumed that, in each process of the coin depositing and dispensing machine 11, the failure detection unit 55 detects occurrence of a failure in such a way that coins cannot be stored in or dispensed from, for example, the storing and dispensing portion 25 to which 25-cent coins are assigned among the storing and dispensing portions 22 to 25 to which denominations are assigned.

The control unit 51 performs the denomination assignment changing function to change the assignment of the denomination of 25-cent coins that is the denomination related to the failure from the storing and dispensing portion 25 in which the failure occurred to another storing and dispensing portion so that the coin depositing and dispensing machine 11 can be continuously used without going out-of-service.

For example, by the first changing function of the control unit 51, the assignment of the denomination of 25-cent coins is changed from the storing and dispensing portion 25 in which the failure occurred to the storing and dispensing portion 26 or the storing and dispensing portion 27 to which no denomination is assigned.

In this case, in the depositing process or the replenishing process, 25-cent coins transported in the transport unit 17 are sorted not to the storing and dispensing portion 25 in which the failure occurred but to the storing and dispensing portion 26 or the storing and dispensing portion 27 to which the assignment is changed, and stored therein, and the depositing process or the replenishing process is completed. In a subsequent depositing process or replenishing process, 25-cent coins are also sorted to and stored in the storing and dispensing portion 26 or the storing and dispensing portion 27.

In a dispensing process, the number of coins of other denominations in an amount equivalent to the amount of the 25-cent coins are calculated, and coins to be dispensed as an alternative from the storing and dispensing portions 22 to 24 for the other denominations are dispensed, thereby completing the dispensing process. In a subsequent dispensing process, when 25-cent coins are stored in the storing and dispensing portion 26 or the storing and dispensing portion 27 due to a depositing process or a replenishing process, the 25-cent coins in the storing and dispensing portion 26 or the storing and dispensing portion 27 are dispensed. When no 25-cent coins are stored in the storing and dispensing portion 26 or the storing and dispensing portion 27, coins of other denominations are dispensed as an alternative.

Accordingly, the coin depositing and dispensing machine 11 can be continuously used without going out-of-service even if a failure occurs in the storing and dispensing portion for a certain denomination during each process.

By the second changing function of the control unit 51, as a denomination that is less frequently used, for example, the coins stored in the storing and dispensing portion 24 for 5-cent coins are collected into the overflow stacker 36 or the coin cassette 37 to empty the storing and dispensing portion 24, and the assignment of 25-cent coins is changed from the storing and dispensing portion 25 in which the failure occurred to the emptied storing and dispensing portion 24. The denomination that is less frequently used is not limited to 5-cent coins and any other denomination may be selected according to the service location.

To move the coins in the storing and dispensing portion 24 into the overflow stacker 36 or the coin cassette 37, coins in the storing and dispensing portion 24 are dispensed into the transport unit 17, transported in the dispensing transporting direction F2 by the transport unit 17, and sorted to and escrowed in the escrow unit 28 from the transport unit 17. After all coins in the storing and dispensing portion 24 are moved into the escrow unit 28, the coins in the escrow unit 28 are fed into the transport unit 17, transported in the deposit transporting direction F1 by the transport unit 17, and diverted by the diverting unit 43 or the diverting unit 46 of the transport unit 17 and stored in the overflow stacker 36 or the coin cassette 37.

In this case, in a depositing process or a replenishing process, first, 25-cent coins being transported in the transport unit 17 are sorted not to the storing and dispensing portion 25 in which the failure occurred but to the storing and dispensing portion 24 to which the assignment is changed, and stored therein, or diverted by the diverting unit 43 or the diverting unit 46 of the transport unit 17 and stored in the overflow stacker 36 or the coin cassette 37, thereby completing the depositing process or the replenishing process. When 5-cent coins are included in the coins being transported in the transport unit 17, the coins are diverted by the diverting unit 43 or the diverting unit 46 of the transport unit 17 and stored in the overflow stacker 36 or the coin cassette 37, thereby completing the depositing process or the replenishing process. After the depositing process or the replenishing process is completed, as described above, 5-cent coins in the storing and dispensing portion 24 are moved into the overflow stacker 36 or the coin cassette 37. In a subsequent depositing process or replenishing process, 25-cent coins are sorted to and stored in the storing and dispensing portion 24, and 5-cent coins are stored in the overflow stacker 36 or the coin cassette 37.

In a dispensing process, the number of coins of other denominations in an amount equivalent to the amount of the 25-cent coins are calculated, and coins to be dispensed as an alternative from the storing and dispensing portions 22 and 23 for other denominations, thereby completing the dispensing process. After the dispensing process is completed, as described above, 5-cent coins in the storing and dispensing portion 24 are moved into the overflow stacker 36 or the coin cassette 37. In a subsequent dispensing process, when 25-cent coins are stored in the storing and dispensing portion 24 due to the depositing process or the replenishing process, 25-cent coins in the storing and dispensing portion 24 are allowed to be dispensed. When 25-cent coins are not stored in the storing and dispensing portion 24, other denominations are dispensed as an alternative. Also, coins of other denominations are dispensed as alternative to 5-cent coins.

Accordingly, the coin depositing and dispensing machine 11 can continuously be used without going out-of-service even when a failure occurs in the storing and dispensing portion for a certain denomination during each process.

By the third changing function of the control unit 51, the assignment of 25-cent coins is changed from the storing and dispensing portion 25 in which a failure occurred, and 25-cent coins are additionally assigned to the storing and dispensing portion 24 to which 5-cent coins have already been assigned as another denomination.

In this case, in a depositing process or a replenishing process, 25-cent coins being transported in the transport unit 17 are sorted not to the storing and dispensing portion 25 in which the failure occurred but to the storing and dispensing portion 24 to which the assignment is changed, and are stored therein while being mixed with 5-cent coins, thereby completing the depositing process or the replenishing process. In a subsequent depositing process or replenishing process, 25-cent coins and 5-cent coins are stored in the storing and dispensing portion 24.

In a dispensing process, the number of coins of other denominations in an amount equivalent to the amount of 25-cent coins are calculated, and coins to be dispensed as an alternative are dispensed from the storing and dispensing portions 22 to for the other denominations, thereby completing the dispensing process. In a subsequent dispensing process, when either or both of 5-cent coins and 25-cent coins are included in coins to be dispensed, in a case where 25-cent coins are stored in the storing and dispensing portion 24 while being mixed with 5-cent coins due to the dispensing process or the replenishing process, coins in the storing and dispensing portion 24 are dispensed. On the other hand, when 25-cent coins are not stored in the storing and dispensing portion 24, other denominations are dispensed as an alternative.

To dispense only coins necessary to be dispensed from the storing and dispensing portion 24 storing 5-cent coins and 25-cent coins in a mixed manner, coins in the storing and dispensing portion 24 are dispensed into the transport unit 17, transported in the dispensing transporting direction F2 by the transport unit 17, and recognized by the recognition unit 31. As a result of the recognition, 5-cent coins or 25-cent coins necessary to be dispensed are sent into the tray 14 from the transport unit 17, and 5-cent coins or 25-cent coins unnecessary to be dispensed are sorted to and stored in the escrow unit 28 from the transport unit 17. After the coins of an equivalent amount to be dispensed are sent into the tray 14 from the transport unit 17, coins in the escrow unit 28 are dispensed into the transport unit 17, transported in the deposit transporting direction F1 by the transport unit 17, and sorted to and stored in the original storing and dispensing portion 24 from the transport unit 17.

Accordingly, the coin depositing and dispensing machine 11 can be continuously used without going out-of-service even when a failure occurs in the storing and dispensing portion for a certain denomination in each process.

One of these first to third changing functions is selected and set in advance, and the changing function that was set is performed.

As described above, when a failure occurs in the storing and dispensing portion for a certain denomination, and the assignment of the denomination related to the failure is changed to another storing and dispensing portion by each changing function, the informing unit 54 provides notification to a display unit of an apparatus in which the coin depositing and dispensing machine 11 is installed or a master terminal connected to the apparatus that replenishment of coins of the denomination related to the failure is necessary.

The notification enables an operator to recognize that the failure has occurred and that replenishment of coins of the denomination related to the failure is necessary, thereby enabling the operator to replenish coins of the denomination related to the failure into the coin depositing and dispensing machine 11 and make preparations for a dispensing process. The replenishment of coins of the denomination related to the failure may be performed by, for example, inputting coins of the denomination related to the failure into the transaction port 13, so that the coins can be replenished into the storing and dispensing portion to which the assignment of the denomination is changed by the same coin process flow as in the depositing process.

As described above, when a failure occurs in the storing and dispensing portion for a certain denomination, and the assignment of the denomination related to the failure is changed to another storing and dispensing portion by one of the changing functions, coins of the denomination related to the failure can be automatically replenished.

To automatically replenish coins of the denomination related to the failure, coins in the overflow stacker 36 or the coin cassette 37 are fed into the transport mechanism 38, and transported to the escrow unit 28 by the transport mechanism 38. The coins transported to the escrow unit 28 are dispensed into the transport unit 17, transported in the deposit transporting direction F1 by the transport unit 17, recognized by the recognition unit 31, and sorted to and stored in storing and dispensing portions for corresponding denominations based on the results of the recognition.

If coins of the denomination related to the failure are included in the coins output from the inside of the overflow stacker 36 or the coin cassette 37, the coins can be automatically replenished into the storing and dispensing portion to which the assignment of the denomination is changed.

Thus, according to the coin depositing dispensing machine 11, when a failure occurs in the storing and dispensing portion for a certain denomination, the assignment of the denomination related to the failure is changed from the storing and dispensing portion in which the failure occurred to another storing and dispensing portion, so that the machine can be continuously used without going out-of-service.

The coin depositing and dispensing machine 11 is restored from the failure that occurred in the storing and dispensing portion for a certain denomination by a failure recovery operation. The coin depositing and dispensing machine 11 can be continuously used without going out-of-service even if a failure occurs, so that a failure recovery operation can be performed in a desired period of time. For example, the failure recovery operation can be performed in a period of time outside of business hours and operating hours, or in a period of time during which the machine is less frequently used, and therefore, the effects from a suspension of service of the coin depositing and dispensing machine 11 can be reduced.

The coin depositing and dispensing machine 11 according to the present embodiment shows an example in which no denomination is assigned to the storing and dispensing portions 26 and 27. However, in the case of a country having a greater number of denominations of coins, denominations are also assigned to the storing and dispensing portions 26 and 27. Thus, when denominations are respectively assigned to both of the storing and dispensing portions 26 and 27, among the changing functions to change the assignment of the denomination, the first changing function is made invalid, and the second or third changing function is adopted.

In a case where denominations are assigned to all storing and dispensing portions 22 to 27, respectively, when a failure occurs in the storing and dispensing portion for a certain denomination in a depositing process, the assignment of the denomination related to the failure may be changed to the feeding unit 21.

Specifically, in a depositing process, coins input from the transaction port 13 are received in the feeding unit 21, fed from the feeding unit 21 into the transport unit 17, transported in the dispensing transporting direction F2 by the transport unit 17, and recognized by the recognition unit 31. Coins recognized as normal are sorted to and escrowed in the escrow unit 28 from the transport unit 17. When the deposit is approved, the coins escrowed in the escrow unit 28 are fed from the escrow unit 28 into the transport unit 17, transported in the deposit transporting direction F1 by the transport unit 17, recognized by the recognition unit 31, and sorted to and stored in the storing and dispensing portions 22 to 25 for corresponding denominations based on the results of the recognition. At this time, if a failure occurs in the storing and dispensing portion for a certain denomination, the assignment of the denomination related to the failure is changed to the feeding unit 21. Therefore, coins of the denomination related to the failure are stored not in the storing and dispensing portion in which the failure occurred but in the feeding unit 21, and the depositing process is completed. Thereafter, coins in the feeding unit 21 are fed into the transport unit 17, and stored in the overflow stacker 36 or the coin cassette 37 by the diverting unit 43 or the diverting unit 46 of the transport unit. In a subsequent dispensing process, coins of other denominations are alternatively dispensed as an alternative as much as the amount of the coins of the denomination related to the failure.

In the case where denominations are assigned to all storing and dispensing portions 22 to 27, respectively, when a failure occurs in the storing and dispensing portion for a certain denomination, the assignment of the denomination related to the failure may be changed to the overflow stacker 36.

Specifically, in a depositing process or dispensing process, when a failure occurs in the storing and dispensing portion for a certain denomination, the assignment of the denomination related to the failure is changed to the overflow stacker 36, the coins of the denomination related to the failure are stored in the overflow stacker 36, thereby completing the process is finished. In a dispensing process, when a failure occurs in the storing and dispensing portion for a certain denomination, coins of other denominations in an amount equivalent to the amount of coins of the denomination related to the failure are dispensed as an alternative, thereby completing the dispensing process.

After the process is completed, coins in the overflow stacker 36 are fed into the transport mechanism 38 and moved to the coin cassette 37 through the escrow unit 28 and the transport unit 17 to empty the overflow stacker 36. By a subsequent depositing or replenishing process, coins of the denomination related to the failure are stored in the overflow stacker 36.

When coins of the denomination related to the failure are dispensed, coins in the overflow stacker 36 are fed into the transport mechanism 38, and sent into the feeding unit 21 through the escrow unit 28 and the transport unit 17. After the coins in an amount equivalent to the amount of the coins to be dispensed are sent into the feeding unit 21, the coins in the feeding unit 21 are fed into the transport unit 17, sent into the tray 14 from the transport unit 17, and dispensed.

In the coin depositing and dispensing machine 11 according to the present embodiment, the escrow unit 28 in which coins are escrowed for checking the coins to be deposited or dispensed is provided. However, when it is not necessary to check whether the deposit is approved, the escrow unit 28 need not be provided.

In the case of the coin depositing and dispensing machine 11 in which the escrow unit 28 is not provided, for example, in FIG. 1, the position of the feeding unit 21 is changed to the position of the escrow unit 28, the transaction port 13 is divided into an input port and an output port, the input port is disposed on the upper side of the changed feeding unit 21, and the output port is disposed so that the front end of the second transport path 19 is connected to the output port. In a depositing process, coins are received in the feeding unit 21 from the input port, and the coins in the feeding unit 21 are fed into the transport unit 17, transported in the deposit transporting direction F1 by the transport unit, recognized by the recognition unit 31, and then transported in the deposit transporting direction F1 by the transport unit 17, recognized by the recognition unit 31, and based on the results of the recognition, sorted to and stored in the storing and dispensing portions 22 to 27 for corresponding denominations. In a dispensing process, coins in the storing and dispensing portions 22 to 27 for denominations to be dispensed are dispensed to the transport unit 17, transported in the dispensing transporting direction F2 by the transport unit 17, and recognized by the recognition unit 31. Coins recognized as normal are dispensed to the output port from the transport unit 17, and coins recognized as not normal are sorted to and escrowed in the feeding unit 21. When the coins recognized as not normal are sent into the feeding unit 21 after the dispensing of coins in an amount equivalent to the amount of coins required to be dispensed is completed, the coins in the feeding unit 21 are fed into the transport unit 17, transported in the deposit transporting direction F1 by the transport unit, and diverted by the diverting unit 45 of the transport unit 17 and stored in the reject box 42.

Thus, even in the coin depositing and dispensing machine 11 without the escrow unit 28, when a failure occurs in the storing and dispensing portion for a certain denomination, by changing the assignment of the denomination related to the failure from the storing and dispensing portion in which the failure occurred to another storing and dispensing portion, the machine can be continuously used without going out-of-service.

INDUSTRIAL APPLICABILITY

The present invention is used as a coin depositing and dispensing machine by a financial institution, a shop, etc. In cases where the machine is used by a financial institution or the like, it may be installed at a teller's counter or as an ATM (Automatic Teller Machine) or the like that is installed inside or outside of a financial establishment. If used in a shop, the machine is used as a cash register or the like.

REFERENCE SINGS LIST

11 Coin depositing and dispensing machine
17 Transport unit
21 Feeding unit
22-27 Storing and dispensing portion
28 Escrow unit
31 Recognition unit
36 Overflow stacker as bulk storing unit
37 Coin cassette as bulk storing unit
51 Control unit
54 Informing unit
55 Failure detection unit

What is claimed is:

1. A coin depositing and dispensing machine comprising:
a transport unit that transports coins to be deposited or dispensed;
a recognition unit that recognizes coins being transported by the transport unit;
a plurality of storing and dispensing portions to which denominations of coins to be stored are assigned and which receive and store coins of corresponding denominations from the transport unit and are capable of dispensing stored coins to the transport unit;
a failure detection unit that detects an occurrence of a failure in the storing and dispensing portion; and
a control unit configured such that when the occurrence of the failure in the storing and dispensing portion for a certain denomination is detected by the failure detection unit, the control unit changes the assignment of the denomination related to the failure from the storing and dispensing portion in which the failure occurred to any other storing and dispensing portion.

2. The coin depositing and dispensing machine according to claim 1, comprising:
an informing unit that provides notification to the outside, wherein
when a failure occurs in the storing and dispensing portion for a certain denomination, the control unit makes the informing unit provide notification that replenishment of coins of the denomination related to the failure is necessary.

3. The coin depositing and dispensing machine according to claim 1, comprising:
a bulk storing unit capable of collectively storing coins of a plurality of denominations and capable of feeding collectively stored coins into the transport unit, wherein
when a failure occurs in the storing and dispensing portion for a certain denomination, the control unit feeds coins from the bulk storing unit into the transport unit and selects from among the coins being transported in the transport unit coins of the denomination related to the failure and replenishes coins into the storing and dispensing portion to which the denomination related to the failure is assigned.

4. The coin depositing and dispensing machine according to claim 1, wherein
when a failure occurs in the storing and dispensing portion storing coins of a denomination to be dispensed, and it is possible for an equivalent amount of coins to be dispensed in other denominations, the control unit makes the storing and dispensing portions for other denominations dispense coins of the other denominations.

5. A coin depositing and dispensing machine comprising:
a transport unit that transports coins to be deposited or dispensed;
a recognition unit that recognizes coins being transported by the transport unit;
a plurality of storing and dispensing portions to which denominations of coins to be stored are assigned and which receive and store coins of corresponding denominations from the transport unit and are capable of dispensing stored coins to the transport unit;
a failure detection unit that detects an occurrence of a failure in the storing and dispensing portion;
a control unit configured such that when the occurrence of the failure in the storing and dispensing portion for a certain denomination is detected by the failure detection unit, the control unit changes the assignment of the denomination related to the failure from the storing and dispensing portion in which the failure occurred to another storing and dispensing portion; and
a bulk storing unit that collectively stores coins of a plurality of denominations, wherein
when a failure occurs in the storing and dispensing portion for a certain denomination, the control unit makes the bulk storing unit store coins for a denomination that is less frequently used, thereby emptying the storing and dispensing portion storing the coins for the less frequently used denomination and changes the assignment of the denomination related to the failure from the storing and dispensing portion in which the failure occurred to the emptied storing and dispensing portion.

6. A coin depositing and dispensing machine comprising:

a transport unit that transports coins to be deposited or dispensed;

a recognition unit that recognizes coins being transported by the transport unit;

a plurality of storing and dispensing portions to which denominations of coins to be stored are assigned and which receive and store coins of corresponding denominations from the transport unit and are capable of dispensing stored coins to the transport unit;

a failure detection unit that detects an occurrence of a failure in the storing and dispensing portion; and a control unit configured such that when the occurrence of the failure in the storing and dispensing portion for a certain denomination is detected by the failure detection unit, the control unit changes the assignment of the denomination related to the failure from the storing and dispensing portion in which the failure occurred to another storing and dispensing portion;

when a failure occurs in the storing and dispensing portion for a certain denomination, the control unit changes the assignment of the denomination related to the failure from the storing and dispensing portion in which the failure occurred to a storing and dispensing portion to which another denomination has already been assigned so that the later-assigned storing and dispensing portion stores coins of a plurality of denominations in a mixed manner.

* * * * *